US009138697B2

(12) United States Patent
Hanada

(10) Patent No.: US 9,138,697 B2
(45) Date of Patent: Sep. 22, 2015

(54) SPIRAL TYPE FLUID MIXER AND APPARATUS USING SPIRAL TYPE FLUID MIXER

(75) Inventor: Toshihiro Hanada, Nobeoka (JP)

(73) Assignee: ASAHI ORGANIC CHEMICALS INDUSTRY CO., LTD., Miyazaki (JP)

( * ) Notice: Subject to any disclaimer, the term of this patent is extended or adjusted under 35 U.S.C. 154(b) by 1190 days.

(21) Appl. No.: 13/125,029

(22) PCT Filed: Jul. 29, 2009

(86) PCT No.: PCT/JP2009/063834

§ 371 (c)(1),
(2), (4) Date: Apr. 19, 2011

(87) PCT Pub. No.: WO2010/047167

PCT Pub. Date: Apr. 29, 2010

(65) Prior Publication Data

US 2011/0199855 A1 Aug. 18, 2011

(30) Foreign Application Priority Data

Oct. 20, 2008 (JP) ..... 2008-270054

(51) Int. Cl.
*B01F 15/00* (2006.01)
*B01F 5/06* (2006.01)
*C10L 3/10* (2006.01)

(52) U.S. Cl.
CPC ..... *B01F 5/0646* (2013.01); *B01F 5/0647* (2013.01); *B01F 5/0656* (2013.01); *B01F 5/0657* (2013.01); *C10L 3/10* (2013.01)

(58) Field of Classification Search
CPC .... B01F 5/0656; B01F 5/0682; B01F 5/0646; B01F 5/0674; B01F 6/0657; C10L 3/10
USPC ..... 366/336–340, 165, 165.2, 175.2, 341
See application file for complete search history.

(56) References Cited

U.S. PATENT DOCUMENTS

| | | | | |
|---|---|---|---|---|
| 1,490,333 | A * | 4/1924 | Lichtenthaeler | 366/340 |
| 3,349,619 | A * | 10/1967 | Millar | 73/861.52 |
| 3,427,002 | A * | 2/1969 | Wilding | 366/336 |
| 3,704,006 | A * | 11/1972 | Grout et al. | 366/339 |
| 6,280,615 | B1 * | 8/2001 | Phillips et al. | 366/338 |

(Continued)

FOREIGN PATENT DOCUMENTS

| | | |
|---|---|---|
| CN | 1062481 A | 7/1992 |
| JP | 51-91175 A | 8/1976 |

(Continued)

OTHER PUBLICATIONS

Office Action, Application No. 200980141661.3 dated Feb. 6, 2013.

*Primary Examiner* — Tony G Soohoo
*Assistant Examiner* — Anshu Bhatia
(74) *Attorney, Agent, or Firm* — Arent Fox LLP

(57) ABSTRACT

A spiral type fluid mixer which enables mixing by a distribution of concentration or distribution of temperature in a flow direction of the fluid made uniform without unevenness and which is compact and enables easy piping work is provided. This spiral type fluid mixer is provided with a fluid inlet, a first flow path which is connected to the fluid inlet, a first spiral flow path which is connected to the first flow path, a plurality of branch flow paths which are branched from the first spiral flow path, a second spiral flow path to which the plurality of branch flow paths are connected, a second flow path which is connected to the second spiral flow path, and a fluid outlet which is connected to the second flow path, the plurality of branch flow path being branched from different positions of the first spiral flow path and being connected with the second spiral flow path at different positions of the second spiral flow path.

8 Claims, 14 Drawing Sheets

(56) References Cited

U.S. PATENT DOCUMENTS

| | | | | |
|---|---|---|---|---|
| 6,379,035 | B1 * | 4/2002 | Kubo et al. | 366/340 |
| 7,041,218 | B1 * | 5/2006 | Liles | 210/512.1 |

FOREIGN PATENT DOCUMENTS

| | | | |
|---|---|---|---|
| JP | 54-128863 | A | 10/1979 |
| JP | 59-21932 | U | 2/1984 |
| JP | 63-016037 | A | 1/1988 |
| JP | 02-307518 | A | 12/1990 |
| JP | 08-141379 | A | 6/1996 |
| JP | 08-146008 | A | 6/1996 |
| JP | 2000-140595 | A | 5/2000 |
| JP | 2001-205062 | A | 7/2001 |
| JP | 2002-243597 | A | 8/2002 |
| JP | 2005-34750 | A | 2/2005 |

* cited by examiner (a)

(b)

SPIRAL TYPE FLUID MIXER AND APPARATUS USING SPIRAL TYPE FLUID MIXER

CROSS-REFERENCE TO RELATED APPLICATION

This application is a National Stage entry of International Application No. PCT/JP2009/063834, filed Jul. 29, 2009, which claims priority to Japanese Patent Application No. 2008-270054, filed Oct. 20, 2008 the disclosure of the prior applications are incorporated in its entirety by reference.

TECHNICAL FIELD

The present invention relates to a spiral type fluid mixer which is used for fluid transport piping in various industrial fields such as chemical factories, the semiconductor production field, food field, medical field, biotech field, etc., in particular relates to a spiral type fluid mixer and apparatus using a spiral type fluid mixer able to mix fluid while making the distribution of concentration or distribution of temperature of the fluid in the direction of flow uniform without any unevenness.

BACKGROUND ART

In the past, as the method of attaching a device inside of a pipe to uniformly mix fluid flowing through the inside of the pipe, as shown in FIG. 12, use of a swirl blade type static mixer element 81 has been the general practice (see, for example, Japanese Patent Publication (A) No. 2001-205062). Usually, the static mixer element 81 is comprised of a square plate twisted 180 degrees about its longitudinal axis as a minimum unit member and has a plurality of such minimum unit members integrally connected in series so that the twisting directions become mutually different directions. This static mixer element 81 is arranged in a pipe 82, male connectors 83 are attached to the two end parts of the pipe 82, flare nuts 85 are attached, and fastening nuts 84 are fastened, whereby a static mixer is formed. At this time, the outside diameter of the static mixer element 81 is designed to be substantially equal to the inside diameter of the pipe 82, so the fluid is able to be effectively agitated.

However, the method of mixing fluid using this conventional static mixer is to agitate flowing fluid along the flow, so as shown in FIG. 13(*a*), it is possible to make the distribution of concentration in the diametrical direction of the pipe uniform without any unevenness, but as shown in FIG. 13(*b*), it is not possible to make the distribution of concentration in the axial direction (flow direction) uniform without any unevenness. For this reason, for example, when mixing water and a chemical at the upstream side of the static mixer, if the mixing ratio of the chemical temporarily increases, the fluid will pass through the static mixer in a state partially denser in concentration in the flow path. At this time, even if the water and chemical are stirred while made uniform in concentration in the diametrical direction, in the axial direction (flow direction), locations in the flow path where the concentration partially becomes denser will end up flowing to the downstream side in the dense state as they are without being diluted much at all (see FIG. 13(*b*)). Due to this, when connected to a semiconductor washing apparatus, in particular, an apparatus which directly coats the surface of a semiconductor wafer with a chemical to perform various types of treatment, there was the problem that different concentrations of the chemical were coated on the surface of the semiconductor wafer and thereby caused defects.

As a method for avoiding unevenness in the distribution of concentration in the axial direction (flow direction), the method of installing a tank in the middle of the flow path, storing the fluid temporarily in the tank, making the concentration in the tank uniform, then running the fluid (not shown) etc. may be mentioned. However, there were the problem that a large space was required for installing the tank and therefore the apparatus became larger, the problem that transport of the fluid from the tank again required a pump, piping, etc., so the number of the parts used increased, and the problem that cost was incurred for installing the pipeline. Further, with this method, the fluid stagnates in the tank. If the fluid stagnates, it becomes a cause of proliferation of bacteria, the bacteria proliferating in the tank flows into the pipeline, and, in a semiconductor production line, deposit on the semiconductor wafer and cause defects.

As another method for avoiding the unevenness in the distribution of concentration in the axial direction (flow direction), as shown in FIG. 14, there was a branching and diluting apparatus for branching flow paths and diluting the fluid (for example, see Japanese Patent Publication (A) No. 8-146008). This apparatus analyzed a sample solution flowing through a tube 91 at a constant speed. It provided a branching part 92 branching the flowing sample to a plurality of flow paths in the middle of the flow path so as to divide the sample solution, changed the inside diameters or lengths of the tubes 93 and 94 of the branch flow paths, combined the flows again at a merging part 96 before a detector 95, and utilized the time difference at which the sample solution was detected for dilution.

CITATION LIST

Japanese Patent Publication (A) No. 2001-205062 and Japanese Patent Publication (A) No. 8-146008

SUMMARY OF INVENTION

However, if using the technique of the conventional branching and diluting apparatus of FIG. 14 for a fluid transport pipe, it is necessary to provide pipelines of different lengths branched from the middle of the main pipeline and then recombine them. For this reason, it is necessary to provide a large number of branched flow paths for making the distribution of concentration in the axial direction (flow direction) uniform without any unevenness in the flow path. In this case, there was the problem of the space for providing the branched pipelines ending up becoming larger. Further, there was the problem that installation of such pipelines required a large number of parts and was both complicated and time-consuming.

The present invention was made in consideration of the above problem in the prior art and has as its object the provision of a spiral type fluid mixer and an apparatus using a spiral type fluid mixer which can mix fluid while making a distribution of concentration or distribution of temperature of the fluid in the direction of flow uniform without any unevenness and which are both compact and facilitate piping work.

Explaining the constitution of the present invention for solving the above problem, the spiral type fluid mixer is characterized in that it has a fluid inlet, a first flow path which is connected to the fluid inlet, a first spiral flow path which is connected to the first flow path, a plurality of branch flow paths which are branched from the first spiral flow path, a second spiral flow path to which the plurality of branch flow paths are connected, a second flow path which is connected to the second spiral flow path, and a fluid outlet which is connected to the second flow path, the plurality of branch flow paths being branched from different positions of the first spiral flow path and being connected with the second spiral flow path at different positions of the second spiral flow path, as a first characterizing feature.

The spiral type fluid mixer is characterized in that it is provided with a main body part which is formed with a first spiral groove and a second spiral groove at its outer circumference and is formed with a plurality of through holes so as to communicate the first spiral groove and the second spiral groove and a housing which fits with an outer circumferential surface of the main body part, the main body part or the housing being formed with the first flow path which is connected to one end part of the first spiral groove and the second flow path which is connected to one end part of the second spiral groove, an end face of the main body part or an outer circumference of the housing having arranged at it the fluid inlet which is connected to the first flow path and the fluid outlet which is connected to the second flow path, the first spiral groove and the housing inside circumferential surface forming the first spiral flow path, the second spiral groove and the housing inside circumferential surface forming the second spiral flow path, and the through holes becoming the branch flow paths, as a second characterizing feature.

The spiral type fluid mixer is characterized in that the first spiral flow path is formed to become gradually smaller in flow section area from one end part which is connected to the first flow path to another end part, as a third characterizing feature.

The spiral type fluid mixer is characterized in that it is provided with a swirl blade which has the shape of a rectangular member twisted about its longitudinal axial line by at least 180° and a housing which fits with side surfaces of the swirl blade, the swirl blade and the housing inside circumferential surface forming the first spiral flow path and the second spiral flow path, the swirl blade being formed with a plurality of through holes so as to communicate the first spiral flow path and the second spiral flow path and being formed with the first flow path which is connected to one end part of the first spiral groove and the second flow path which is connected to one end part of the second spiral groove, an outer circumference of the housing having arranged at it the fluid inlet which is connected to the first flow path and the fluid outlet which is connected to the second flow path, and the through holes becoming the branch flow paths, as a fourth characterizing feature.

The spiral type fluid mixer is characterized in that the through holes are formed with substantially the same opening areas, as a fifth characterizing feature.

The housing is provided with a ferrule coupling part, as a sixth characterizing feature.

The housing is formed by two or more members, each member is provided with a flange part, and the flange parts are fastened by clamps, as a seventh characterizing feature.

The housing is comprised of two cylindrical parts, an outer circumference of one end part of each cylindrical part is provided with a flange part, while the other end part is provided with a reduced diameter part which is reduced in diameter, and the main body part is inserted into opening parts of the two cylindrical parts at the flange part sides, and the flange parts are fastened by clamps, as an eighth characterizing feature.

The housing is comprised of a body provided with a hollow chamber opening at the bottom, the hollow chamber having an inlet flow path and outlet flow path communicated with it, and a lid member closing an opening of the hollow chamber, and the main body part is arranged fit into the hollow chamber of the housing, as a ninth characterizing feature.

The spiral type fluid mixer is used to make a temperature or concentration of a flowing substance uniform in a line in which a temperature or concentration of the substance changes over time, as an 10th characterizing feature.

The substance is a gas or liquid, as an 11th characterizing feature.

The spiral type fluid mixer is used to make a mixing ratio of at least two substances uniform in a line in which a mixing ratio of the substances changes over time, as a 12th characterizing feature.

The spiral type fluid mixer is arranged at a downstream side of a merging part of a line in which at least two substances flow, as a 13th characterizing feature.

The substance is any of a gas, liquid, solid, or powder, as a 14th characterizing feature.

The substance is at least water and any one of a pH adjuster, liquid fertilizer, bleach, bactericide, surfactant, or a liquid chemical, as a 15th characterizing feature.

The substance is at least a first liquid chemical and a second liquid chemical or a metal, as a 16th characterizing feature.

The substance is at least a waste liquor and a pH adjuster, flocculant, or microorganisms, as an 17th characterizing feature.

The substance is at least a first petroleum oil, a second petroleum oil, additive, or water, as an 18th characterizing feature.

The substance is at least an adhesive and a curing agent, as a 19th characterizing feature.

The substance is at least a first resin and any one of a second resin, solvent, curing agent, or coloring agent, as a 20th characterizing feature.

The substance is at least a first food material and any one of a second food material, food additive, seasoning, microorganisms, or nonflammable gas, as a 21st characterizing feature.

The substance is at least air and a flammable gas, as a 22nd characterizing feature.

The substance is at least a first nonflammable gas and a second nonflammable gas or steam, as a 23rd characterizing feature.

The substance is any one of at least water, liquid chemical, or a food material and any one of air, a nonflammable gas, or steam, as a 24th characterizing feature.

The substance is a first synthesis intermediate and any one of a second synthesis intermediate, additive, liquid chemical, or a metal, as a 25th characterizing feature.

The parts of the spiral type fluid mixer of the present invention such as the main body part 11, cylindrical member 15, swirl blade 31, etc. may be made of any resin. Any of polyvinyl chloride, polypropylene (hereinafter referred to as "PP"), polyethylene, etc. may be used. In particular, when using a corrosive fluid as the fluid, polytetrafluoroethylene (hereinafter referred to as "PTFE"), polyvinylidene fluoride, tetrafluoroethylene-perfluoroalkyl vinyl ether copolymer resin (hereinafter referred to as "PFA"), or another fluororesin is preferable. If a fluororesin, use for a corrosive fluid is possible. Further, even if corrosive gas passes through the parts, there is no longer any concern over corrosion of the pipe members, so this is preferred. Further, the members forming the main body part or housing may be transparent or semi-transparent members. This is preferable in that it enables the state of mixing of the fluid to be visually confirmed. Further, depending on the substance running through the fluid mixer, the parts may be made of iron, copper, copper alloy, brass, aluminum, stainless steel, or another metal.

The present invention is structured in the above way and has the following superior effects.

(1) Even in a state where the concentration of a chemical temporarily becomes denser or thinner in a flow path, it is possible to mix the fluid while making the distribution of concentration of the fluid in the direction of flow uniform without any unevenness, possible to supply a chemical in a stable concentration, and possible to prevent defects due to changing concentrations of chemicals in various industrial fields.

(2) Even in a state in which the temperature of the fluid temporarily becomes higher or becomes lower in a flow path, it is possible to mix the fluid while making the distribution of temperature of the fluid in the direction of flow uniform with no unevenness, possible to supply fluid by a stable temperature, possible to stabilize the temperature more in a hot water heater etc., and possible to prevent burns.

(3) The fluid mixer can be made smaller in size and the installation space can be kept to the minimum necessary.

Below, the present invention will be able to be understood more clearly from the attached drawings and the description of the preferred embodiments of the present invention.

DESCRIPTION OF EMBODIMENTS

Figure 1:
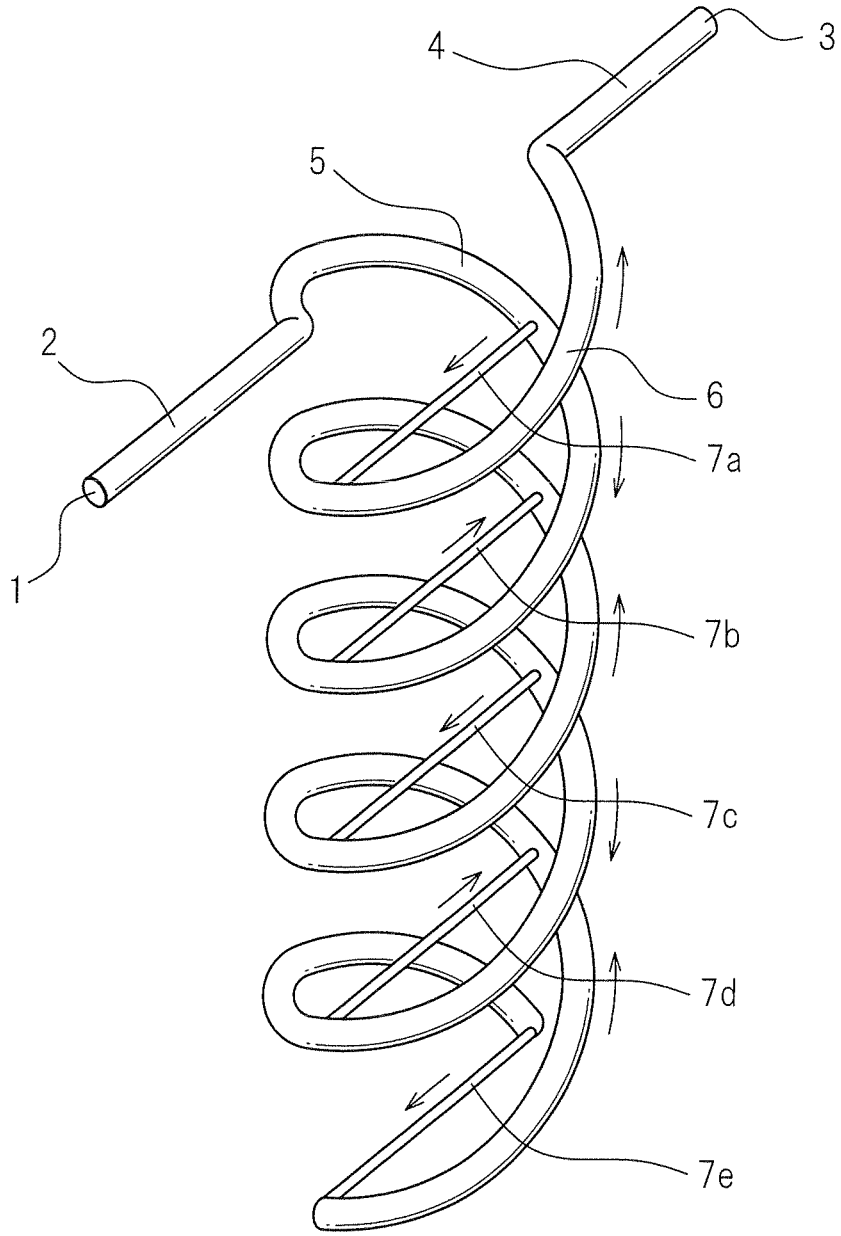
FIG. 1 is a schematic view of a pipe flow path showing a spiral type fluid mixer of a first embodiment of the present invention.

Below, embodiments of the present invention will be explained with reference to the embodiments shown in the drawings, but the present invention is not limited to these embodiments needless to say.

Below, a spiral type fluid mixer of a first embodiment of the present invention will be explained with reference to FIG. 1.

The spiral type fluid mixer is provided with a fluid inlet 1 into which the fluid flows, a first flow path 2 which is connected to the fluid inlet 1, a fluid outlet 3 from which the fluid flows, and a second flow path 4 which is connected to the fluid outlet 3. A first spiral flow path 5 which is connected to the first flow path 2 and a second spiral flow path 6 which is connected to the second flow path 4 are arranged at a fixed interval so that centers of the spirals are on the same axial line. On the first spiral flow path 5, branch flow paths 7*a* to 7*e* which are respectively connected to any positions on the second spiral flow path 6 are provided at equal interval distances. Further, the ends parts of the first spiral flow path 5 and the second spiral flow path 6 which are not connected to the first and second flow paths 2 and 4 are provided with the branch flow path 7*e* connected to them. This plurality of branch flow paths 7*a* and 7*e* are branched from different positions of the first spiral flow path 5 and are connected to the second spiral flow path 6 at different positions on the second spiral flow path 6. The present embodiment is for example connected by tubes etc.

Next, the action of the spiral type fluid mixer of the first embodiment of the present invention will be explained.

Water and a chemical are mixed at an upstream side of the spiral type fluid mixer. Temporarily, the chemical becomes denser in concentration. At this time, the now partially denser concentration chemical flowing in the flow path flows from the fluid inlet 1 into the first flow path 2 to the first spiral flow path 5. A part of the denser concentration chemical flows to the location of the first spiral flow path 5 to which the branch flow path 7*a* is connected. At that time, that part flows through the branch flow path 7*a*, passes through the second spiral flow path 6, and flows from the second flow path 4 to the fluid outlet 3. The remaining chemical flows to the downstream side of the first spiral flow path 5. Further, a part of the denser concentration remaining chemical flows to the location to which the branch flow path 7*b* is connected. At that time, that part flows through the branch flow path 7*b*, passes through the second spiral flow path 6, and flows from the second flow path 4 to the fluid outlet 3. The remaining chemical flows to the downstream side of the first spiral flow path 5. Further, a part of the denser concentration remaining chemical flows to a location to which the branch flow path 7*c* is connected in the same way as the chemical flowing through the branch flow path 7*b*. At that time, that part flows through the branch flow path 7*c*, passes through the second spiral flow path 6, and flows from the second flow path 4 to the fluid outlet 3. Below, in the same way as 7*a*, 7*b*, and 7*c*, parts of the denser concentration remaining chemical flow through 7*d* and 7*e*, pass through the second spiral flow path 6, and flow from the second flow path 4 to the fluid outlet 3.

At this time, a part of the denser concentration chemical flowing through the branch flow path 7*a* flows out from the fluid outlet 3 earlier than the other not denser concentration chemicals. Portions of the denser concentration chemical flow out from the fluid outlet 3 by a time difference in the order of the branch flow path 7*b*, branch flow path 7*c*, branch flow path 7*d*, and branch flow path 7*e*. That is, the partially denser concentration chemical flowing through the flow path flows divided into five parts by a time difference due to the spiral type fluid mixer. These are mixed with the not denser concentration chemical whereby it is possible to uniformly mix the chemical while making the distribution of concentration in the direction of flow uniform without any unevenness. At this time, if the branch flow paths are substantially the same in inside diameter, the part of the denser concentration chemical is divided into substantially five equal parts, so it is possible to uniformly mix the chemical while making the distribution of concentration in the direction of flow uniform without any unevenness.

Note that, in the present embodiment of FIG. 1, the branch flow paths 7*a* to 7*e* are provided at equal interval distances with respect to the axial lines of the spirals of the first and second spiral flow paths 5 and 6, but to adjust the time difference given to the fluid which flows through the branch flow paths 7*a* and 7*e*, it is possible to freely set the positions connected to or possible to form the first and second spiral flow paths 5 and 6 so that the flow section areas become gradually smaller from the one end parts respectively connected to the first flow path 2 and second flow path 4 toward the other end parts. The number of the branch flow paths 7*a* to 7*e* is not particularly limited. The larger then number of branch flow paths 7*a* to 7*e*, the finer and more uniform the distribution of concentration of the fluid in the direction of flow without unevenness.

Figure 2:
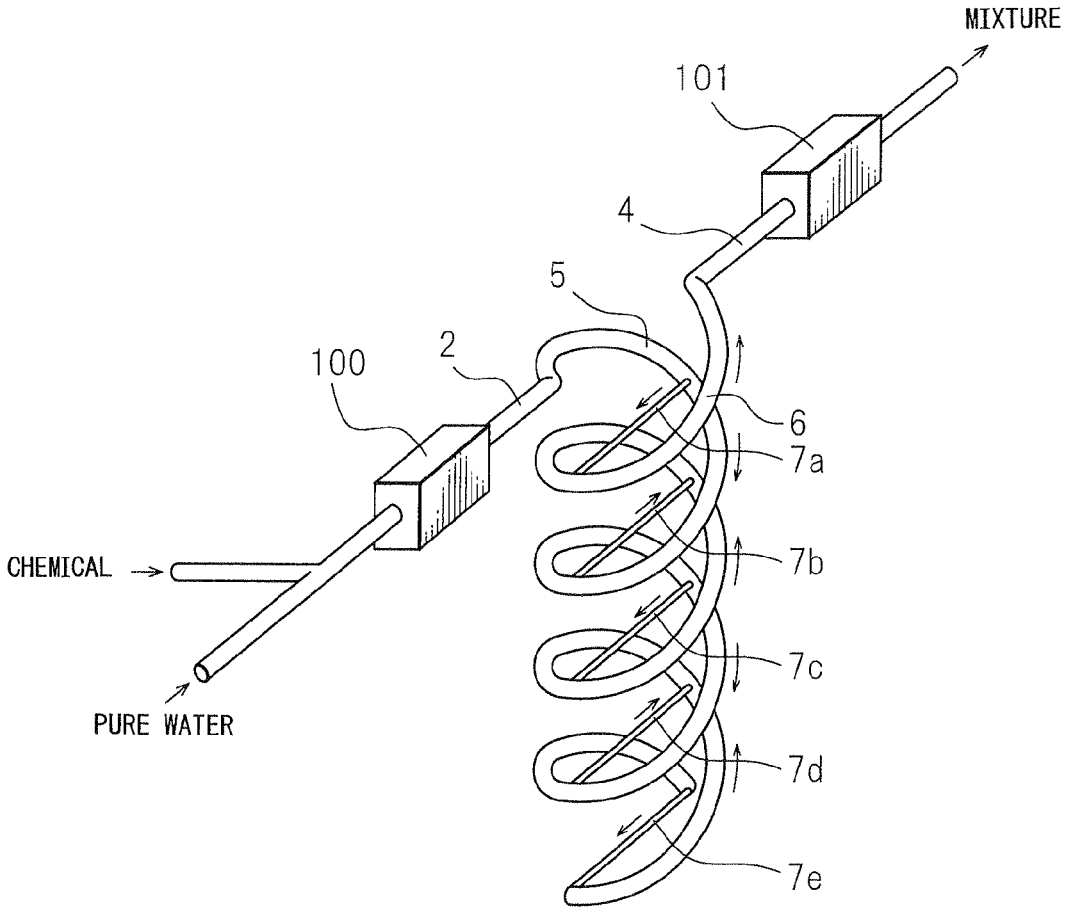
FIG. 2 is a schematic view showing a device for measuring the concentration of fluid using the spiral type fluid mixer of FIG. 1.

Here, the action of dividing a part of a denser concentration chemical by the spiral type fluid mixer to make the distribution of concentration of the fluid in the direction of flow uniform without unevenness will be explained. As shown in FIG. 2, a spiral type fluid mixer of FIG. 1 is arranged at the downstream side of a merging part of lines through which two substances, that is, pure water and a chemical, flow. In this line, densitometers 100 and 101 are set at the upstream side and the downstream side of the spiral type fluid mixer of FIG. 1. This thereby forms an apparatus which mixes pure water and a chemical from the upstream side. The pure water and chemical are run by a fixed ratio, the concentration of the chemical is made denser (ratio of chemical to pure water is made larger) in the middle of this for an instant, then, after this, the fluids are run by the original fixed ratio to cause unevenness in the distribution of concentration. If measuring the concentrations at the upstream side and downstream side at this time, the result becomes like in FIG. 3 and FIG. 4.

Figure 3:
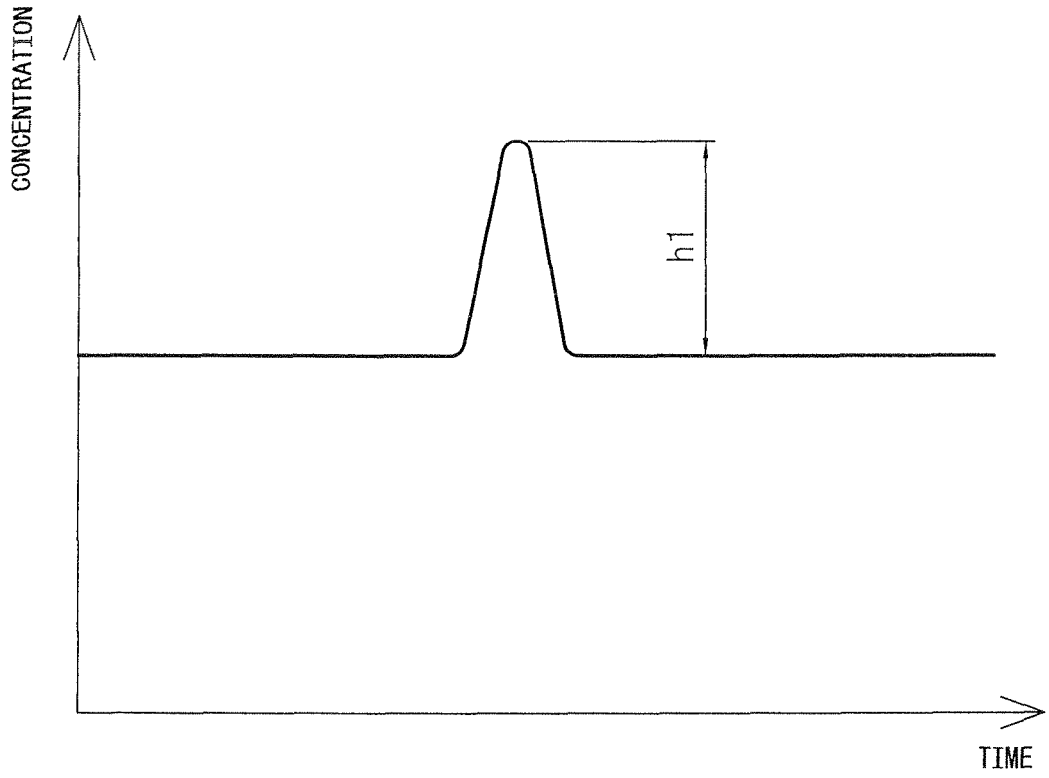
FIG. 3 is a graph obtained by measuring the concentration at an upstream side of the spiral type fluid mixer of FIG. 2.
Figure 4:
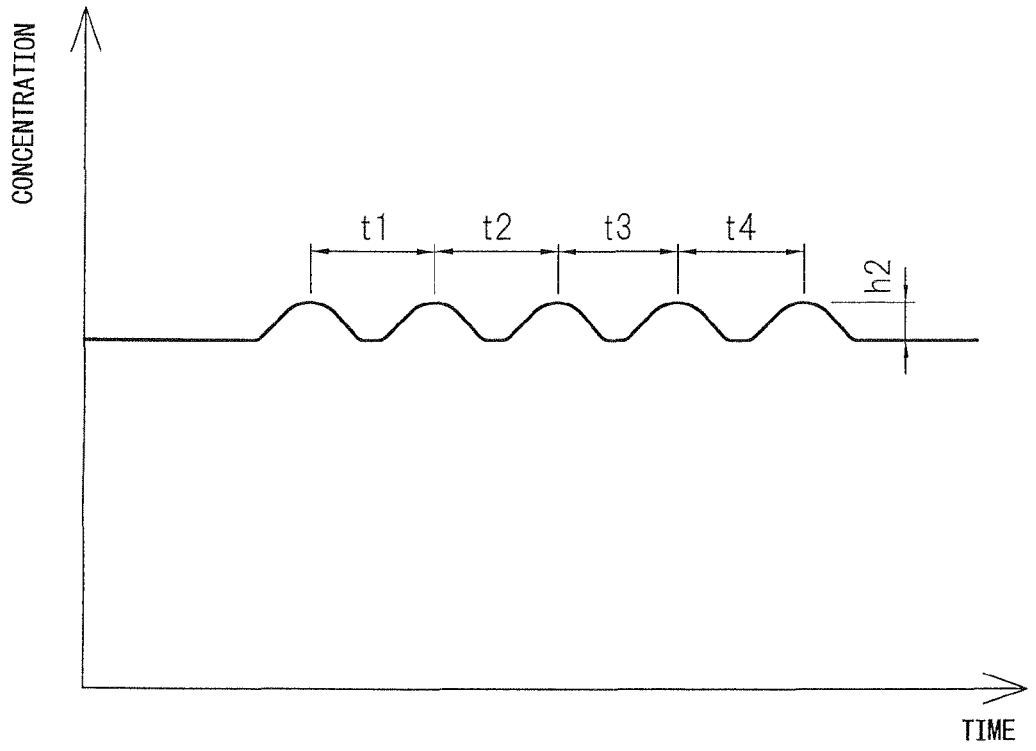
FIG. 4 is a graph obtained by measuring the concentration at a downstream side of the spiral type fluid mixer of FIG. 2.

FIG. 3 is a graph of the densitometer 100 which is placed at an upstream side of the spiral type fluid mixer. Here, the abscissa shows the elapsed time, while the ordinate shows the concentration. When the concentration becomes denser at a certain fixed time, a peak (h1) appears as illustrated. FIG. 4 is a graph of the densitometer 101 which is placed at a downstream side of the spiral type fluid mixer. The single peak of concentration is dispersed into five peaks. The height of the peaks (h2) becomes about one-fifth of the single peak. The interval t1 between the peaks of concentration corresponds to the time from when the fluid passes the position of the branch flow path 7*a* in the first spiral flow path 5 to when it reaches the branch flow path 7*b*. Similarly, t2 corresponds to the time from the branch flow path 7*b* to the branch flow path 7*c*, t3 corresponds to the time from the branch flow path 7*c* to the branch flow path 7*d*, and t4 corresponds to the time from the branch flow path 7*d* to the branch flow path 7*e*. At this time, by changing the lengths to the branch flow paths 7*a* to 7*e* of the first spiral flow path 5, it is possible to change the times t1 to t9 when the peaks (h2) appear. If further increasing the number of the branch flow paths 7*a* to 7*e*, the heights of the peaks (h2) can be kept to heights of an extent dividing the upstream side peak (h1) by the number of branch flow paths. Note that, even if not providing the spiral type fluid mixer, the peak of concentration shown in FIG. 3 will sometimes fall somewhat due to the flow of the fluid, but the peak (h1) will substantially remain unchanged during the flow.

Note that, in the present embodiment, the unevenness of the distribution of concentration is explained, but a similar effect can be obtained even for making the distribution of temperature when mixing hot water and cold water uniform in the direction of flow. Utilization for a hot water heater for the purpose of making the distribution of temperature uniform becomes possible. By making the temperature of the partially high temperature fluid in the flow path uniform in the flow direction, it is possible to stabilize the temperature and prevent burns due to the flow of hot water. Further, in waste liquor treatment etc., when treatment would be obstructed due to a sudden change in concentration or when trouble would arise if a certain level or more of concentration were exceeded, it is possible to use the spiral type fluid mixer of the present invention for this piping line so as to make the concentration in the flow direction uniform and so as to enable stable treatment of waste liquor. Further, the flowing fluid may also be a gas. For example, in the purification of the exhaust gas of an automobile, when the concentration of exhaust gas becomes rapidly denser at the time of engine start or acceleration, the load on the catalyst for the purification may become larger and the purification performance may fall, but by using the spiral type fluid mixer of the present invention for this piping line of the exhaust gas, it would be possible to make the concentration in the flow direction uniform and possible to purify the exhaust gas stably at all times. Further, by the flow path of the spiral type fluid mixer repeatedly being branched and merged, mixing is performed not only in the flow direction, but also the diametrical direction. In the present invention, for convenience in explaining the action, the "fluid inlet" and the "fluid outlet" are described, but a similar effect can be obtained even if running the fluids in the opposite direction. In this case, the fluid outlet becomes the inlet into which the fluid flows, while the fluid inlet becomes the outlet from which the fluid flows.

Figure 5:
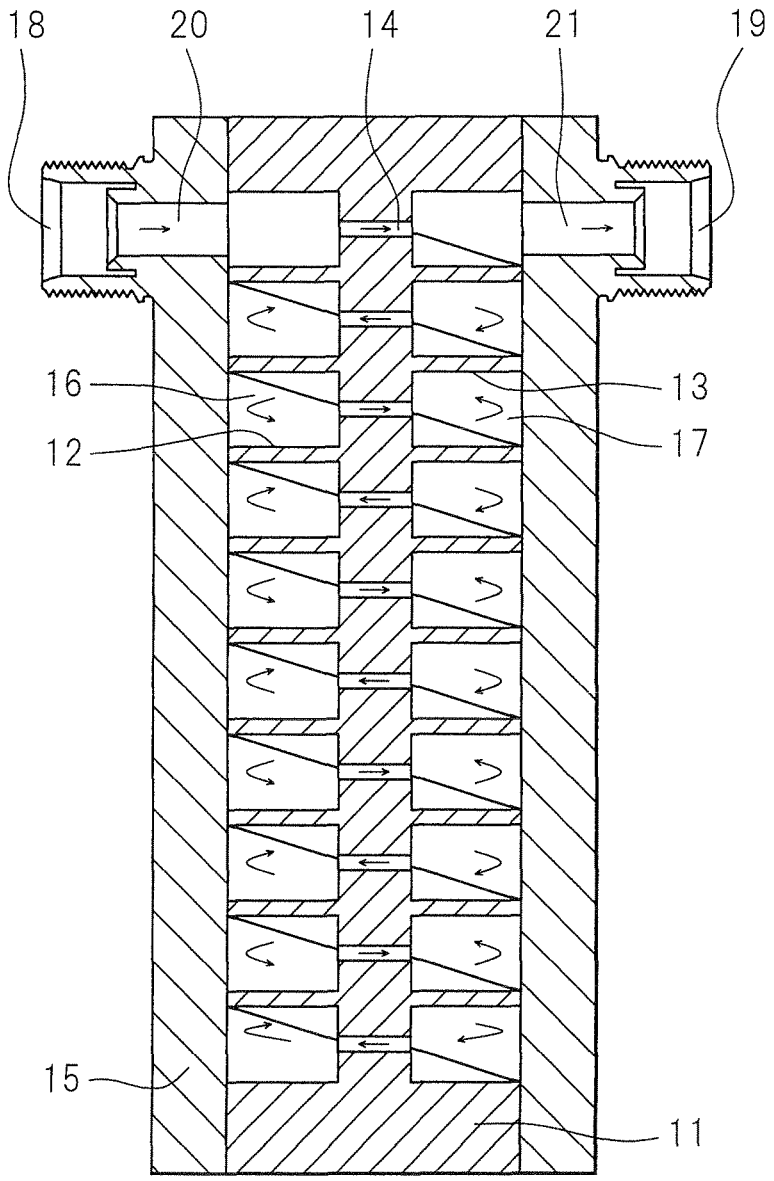
FIG. 5 is a longitudinal cross-sectional view of a pipe flow path showing a spiral type fluid mixer of a second embodiment of the present invention.

Next, the action of the spiral type fluid mixer of the second embodiment of the present invention will be explained with reference to FIG. 5.

A PTFE main body part 11 is formed into a columnar shape. At the outer circumferential surface of the main body part 11, a first spiral groove 12 and a second spiral groove 13 are provided in parallel. The second spiral groove 13 is arranged between the grooves of the first spiral groove 12, while the first spiral groove 12 is arranged between the grooves of the second spiral groove 13. At the bottom surface of the first spiral groove 12, through holes 14 which form a plurality of branch flow paths which communicate with the second spiral groove 13 are provided at equal interval distances.

The cylindrical member 15 forming the PP housing is formed into a substantially cylindrical shape. The inside diameter of the cylindrical member 15 is formed to be substantially the same as the outside diameter of the main body part 11. The member is fit and fastened with the main body part 11 by shrink fitting in a state sealed against the outer circumferential surface of the main body part 11. By fitting the cylindrical member 15 with the main body part 11, the first spiral groove 12 of the main body part 11 and the inside circumferential surface of the cylindrical member 15 form the first spiral flow path 16, while the second spiral groove 13 of the main body part 11 and the inside circumferential surface of the cylindrical member 15 form the second spiral flow path 17. At the outer circumferential surface of the cylindrical member 15, a fluid inlet 18 and a fluid outlet 19 are provided.

A first flow path 20 which connects the fluid inlet 18 and one end part of the first spiral groove 12 of the main body part 11 and a second flow path 21 which connects the fluid outlet 19 and one end part of the second spiral groove 13 of the main body part 11 are provided.

Note that, the cylindrical member 15 forming the housing may be fit with the main body part 11 by any method so long as being fit with it in a sealed state. As the sealing method, an O-ring may be used or a cylindrical member 15 comprised of a tube or other soft member may be used for tight fitting. Further, in addition to shrink fitting, welding or adhesion is also possible. Further, the method of fastening the cylindrical member 15 and the main body part 11 may be to fit a closed bottom cylindrically shaped cylindrical member over the main body part 11 and use a cap nut to seal the cylindrical member so as to fasten the member to the main body part 11 in a state sealed with its outer circumferential surface (not shown) or to screw the main body part 11 to the cylindrical member 15 (not shown).

Next, the action of the spiral type fluid mixer of the sixth embodiment of the present invention will be explained.

Water and a chemical are mixed and flow from an upstream side of the spiral type fluid mixer. When they flow in a state with the concentration of the chemical temporarily denser, the partially denser concentration chemical flowing through the flow path flows in from the fluid inlet 18, passes through the first flow path 20, and flows to the first spiral flow path 16. The partially denser concentration chemical which flows through the first spiral flow path 16 flows while being divided by the through holes 14. The partially denser concentration chemical flows through the second spiral flow path 17 with a time difference to be mixed with the not denser concentration chemical whereby the chemical is mixed to become uniform of the fluid in the direction of flow. It then can pass through the second flow path 21 and flow out from the fluid outlet 19. The action of making the distribution of concentration of the fluid in the direction of flow uniform without unevenness in the second embodiment is similar to that of the first embodiment, so the explanation is omitted.

The spiral type fluid mixer of the present embodiment enables easy formation of through holes 14 which connect the bottom surface of the first spiral groove 12 and the bottom surface of the second spiral groove 13, so it is possible to freely change the positions of provision and number of provision of through holes 14 and possible to finely and evenly adjust the time difference of flow. In particular, by increasing the number of turns of the spirals of the first and second spiral grooves 12 and 13 to lengthen the first and second spiral flow paths 16 and 17, it is possible to make the distribution of concentration in the flow direction of fluid more finely uniform without unevenness. Further, the spiral type fluid mixer of the present embodiment is relatively easily to form despite the complexity of the flow path and the number of parts is also small, so production is easy. Further, the flow path can be structured small, so the spiral type fluid mixer can be made small in size and installation is possible without taking up piping space. Further, even when connecting the spiral type fluid mixer to the piping line, installation can be completed by just connecting the fluid inlet 18 and the fluid outlet 19 by couplings etc., so the piping work is easy and can be completed in a short time.

Here, the through holes 14 are preferably formed to substantially the same flow section areas. The flow rates of the fluids divided by the through holes 14 are constant, so the fluid which flows into the spiral type fluid mixer is divided substantially equally by the number of the through holes 14 then is merged with a time difference to form the final flow, so the distribution of concentration can be made uniform without unevenness. Further, in the present embodiment, the fluid inlet 18 and the fluid outlet 19 are provided at the outer circumferential surface of the cylindrical member 15, but it is also possible to not provide them at the cylindrical member 15, but provide them at the end face of the main body part 11.

Figure 6:
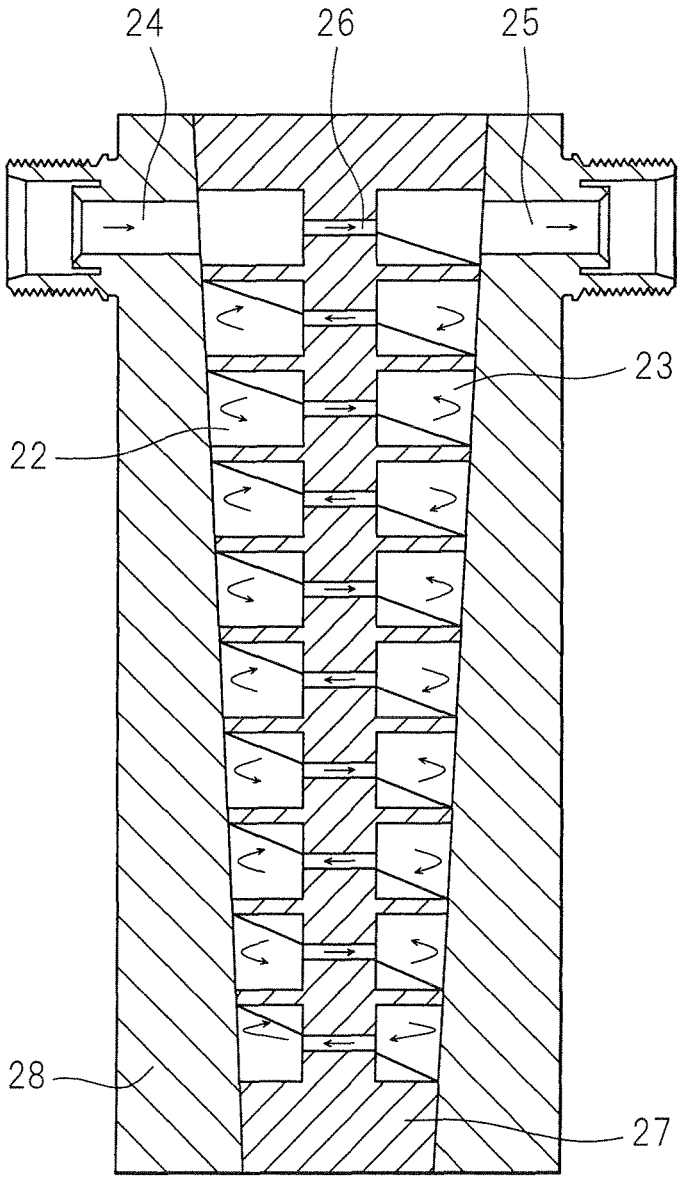
FIG. 6 is a longitudinal cross-sectional view showing a different structure of the spiral flow path in the second embodiment.

Further, as shown in FIG. 6, the first spiral flow path 22 is preferably formed so as to become gradually smaller in flow section area from one end part which is connected with the first flow path 24 toward the other end part. This is preferable in that the fluid which flows through the first spiral flow path 22 suffers a pressure loss due to the fluid being divided and flowing out from the through holes 26, so the flow rate at the downstream side of the first spiral flow path 22 easily falls, therefore by gradually reducing the flow section area of the first spiral flow path 22 so that the fluid flows by a constant rate even if a pressure loss occurs, it is possible to stabilize the time difference of the divided parts of the flowing fluid. Further, the second spiral flow path 23 is preferably formed so as to become gradually smaller in flow section area from one end part which is connected with the second flow path 25 toward the other end part. This is preferable in that the fluid which flows from the first spiral flow path 22 through the through holes 26 to the second spiral flow path 23 suffers a pressure loss due to the fluid being divided and flowing out from the through holes 26, so flows in a state where the flow rate at the downstream side of the first spiral flow path 22 falls, therefore by gradually reducing the flow section area of the second spiral flow path 23 in accordance with the state of pressure loss so that the fluid flows by a constant rate, it is possible to stabilize the time difference of the divided parts of the flowing fluid. Note that, the method of making the first and second spiral flow paths 22 and 23 smaller in flow section area may be to provide a main body part 27 with a gradually reduced diameter of the outer circumferential surface as shown in FIG. 6 and to fit a cylindrical member 28 matched in shape with this outer circumferential surface so as to form the first and second spiral flow paths 22 and 23 or also to form the spiral grooves to be gradually shallower in depth (not shown) or form the spiral grooves to be gradually narrower in width (not shown) or to combine these.

Figure 7:
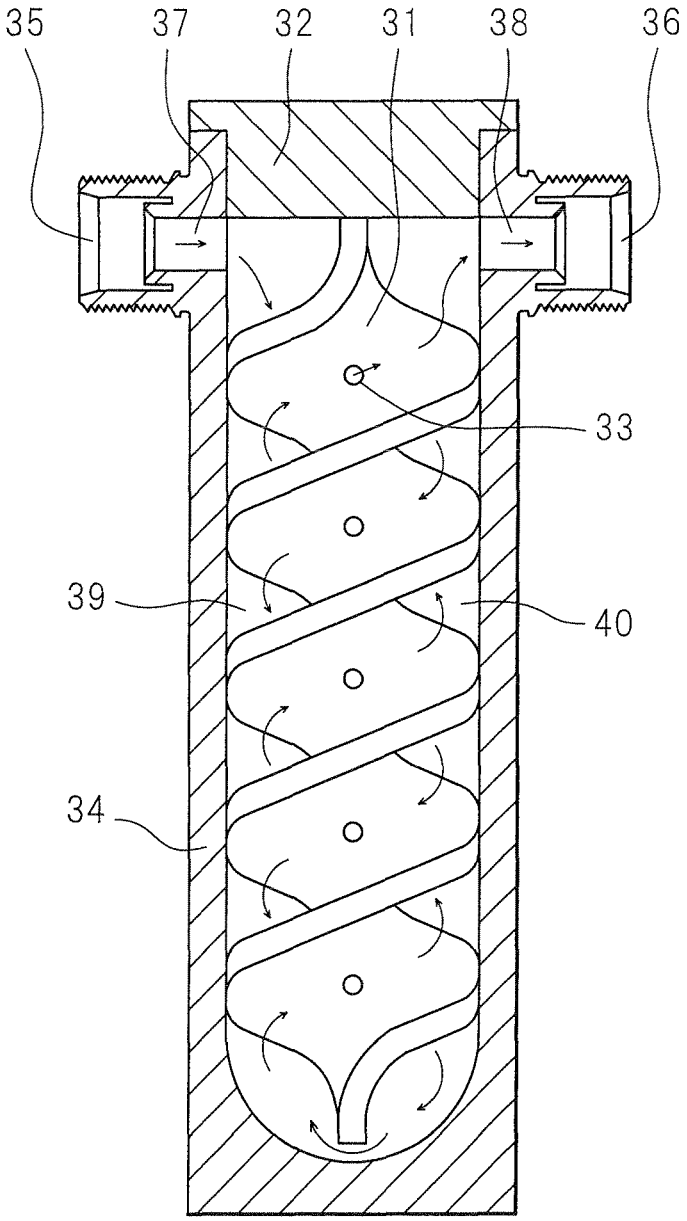
FIG. 7 is a schematic view of a pipe flow path showing a spiral type fluid mixer of a third embodiment of the present invention.

Next, referring to FIG. 7, a spiral type fluid mixer of a third embodiment of the present invention will be explained.

A PP swirl blade 31 is formed by a rectangular member twisted around its longitudinal axial line about five turns. The swirl blade 31 is provided with through holes 33 at equal interval distances. Further, the swirl blade 31 is provided with one end part fastened to the base member 32.

A cylindrical member 34 forming the PP housing is formed into a closed bottom cylindrical shape. The inside diameter of the cylindrical member 34 is formed to be substantially the same as the outside diameter of the swirl blade 31. At the outer circumferential surface of the cylindrical member 34, a fluid inlet 35 and a fluid outlet 36 are provided. A first flow path 37 which connects with the fluid inlet 35 and a second flow path 38 which connects with the fluid outlet 36 are provided. The cylindrical member 34 is fit and fastened with the swirl blade 31 by shrink fitting in a state sealed against the outer circumferential surface of the swirl blade 31. Further, between the end part of the swirl blade 31 at the side which is connected to the base member 32 and the bottom surface of the cylindrical member 34, a clearance is provided forming one of the branch flow paths. By fitting the cylindrical member 34 over the swirl blade 31, the surface of the swirl blade 31 at the side communicating with the first flow path 37 and the inside circumferential surface of the cylindrical member 34 form the first spiral flow path 39, while the surface of the swirl blade 31 at the side communicating with the second flow path 38 and the inside circumferential surface of the cylindrical member 34 form the second spiral flow path 40. At this time, the through holes 33 of the swirl blade 31 become the branch flow path.

Note that, the cylindrical member 34 may be fit with the swirl blade 31 by any method so long as being fit in a sealed state with it. The variations described in the second embodiment may be mentioned. Further, the swirl blade 31 may have the shape of a rectangular member twisted along its longitudinal axial line by 180° or more. It is also possible not to form it by twisting a rectangular member, but shape the swirl blade 31 by injection molding or cutting. When forming it by twisting a rectangular member, it may also be formed by heat deformation, press forming, etc. The number of the turns of the twist of the swirl blade 31 may be one giving a shape of a rectangular member twisted along its longitudinal axial line by 180° or more. By twisting it by 180° or more, a spiral flow path is formed with the cylindrical member 34. By forming a greater number of turns, it is possible to make the distribution of concentration of the fluid in the direction of flow more finely uniform without unevenness.

The third embodiment is similar to the second embodiment in the action of making the distribution of concentration of the fluid in the direction of flow uniform without unevenness, so the explanation is omitted. In the same way as the second embodiment, the through holes 33 are preferably formed to substantially the same flow section areas. The swirl blade 31 of the present embodiment can be produced easily and in a short time and the manufacturing cost can be kept low. Further, it is easy to form a swirl blade 31 changed in number of turns of the swirl blade 31, so by assembling the swirl blade 31 and the cylindrical member 34 and providing it in a disassembleable manner, it becomes possible to change to swirl blades 31 with different numbers of turns and through holes 33 and possible to suitably mix fluids in accordance with the state of the fluids to be mixed.

Figure 8:
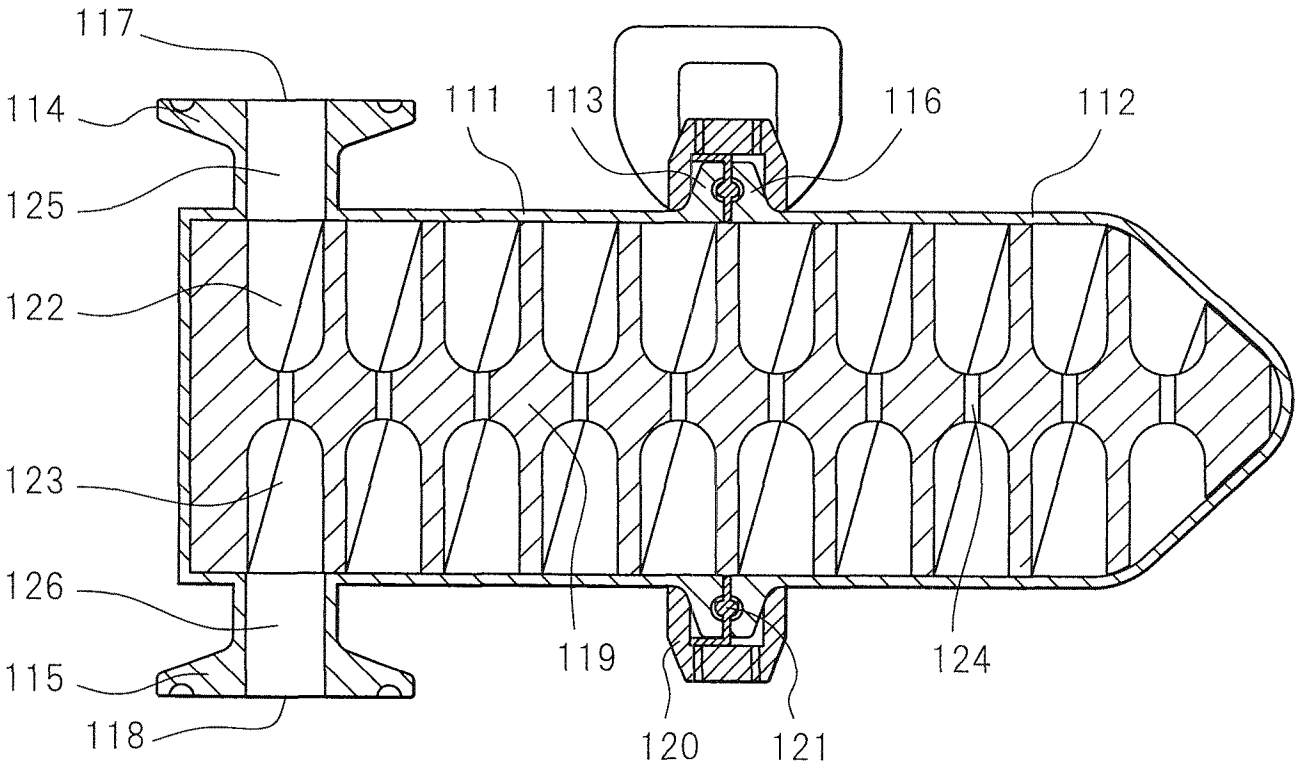
FIG. 8 is a longitudinal cross-sectional view of a pipe flow path showing a spiral type fluid mixer of a fourth embodiment of the present invention.

Next, a spiral type fluid mixer of a type using a ferrule of a fourth embodiment of the present invention will be explained with reference to FIG. 8.

Among the SUS304 first and second cylindrical parts 111 and 112, the first cylindrical part 111 is provided with a flange part 113 at the outer circumference of one end part and is provided with openings forming a fluid inlet 117 and fluid outlet 118 which stick out at axially symmetric positions at the outer circumference of the other end part. The outer circumference of the fluid inlet 117 and the outer circumference of the fluid outlet 118 are provided with ferrule coupling parts 114 and 115. A first flow path 125 which communicates the fluid inlet 117 and the inside of the first cylindrical part 111 and a second flow path 126 which communicates the fluid outlet 118 and the inside of the first cylindrical part 111 are provided. The second cylindrical part 112 has a closed bottom cylindrical shape. At the outer circumference of the open end part, a flange part 116 is provided.

A SUS304 main body part 119 is formed into a columnar shape. The outer circumferential surface of the main body part 119 is provided with a first spiral groove 122 and a second spiral groove 123 in parallel. The second spiral groove 123 is arranged between the grooves of the first spiral groove 122, while the first spiral groove 122 is arranged between the grooves of the second spiral groove 123. The bottom surface of the first spiral groove 122 is provided with through holes 124 forming a plurality of branch flow paths communicated with the second spiral groove 123 at equal intervals. The two end parts of the main body part 119 are formed into shapes matching the inside circumferential surfaces of the first and second cylindrical parts 111 and 112. The outer circumferences are formed into substantially the same diameters as the inner circumferences of the first and second cylindrical parts 111 and 112. The main body part 119 is inserted into the opening parts of the flange parts 113 and 116 of flange parts 113 and 116 of the first and second cylindrical parts 111 and 112. The end faces of the flange parts 113 and 116 have a gasket 121 sandwiched between them. The flange parts 113 and 116 are fastened by clamps 120. A first flow path 125 of the first cylindrical part 111 communicates with the end part of the first spiral flow path which forms the first spiral groove 122 of the main body part 119, while a second flow path 126 communicates with the end part of the second spiral flow path which forms the second spiral groove 123 of the main body part 119. At this time, the first and second cylindrical parts 111 and 112 form the housing.

Note that, the flange parts 113 and 117 of the present embodiment are connected in the same way as the method of connection of a ferrule coupling. A ferrule coupling may also be used. In addition to the shape of the present embodiment, it is also possible to use a ferrule coupling to form the spiral type fluid mixer in an easily assembleable manner. For example, it is also possible to configure the mixer to fit the main body part in a housing provided with ferrule coupling parts at the two end parts of the cylindrically shaped housing. Further, the shape of the main body part may also be made the shape of the third embodiment (not shown).

Next, the action of the fourth embodiment will be explained.

The fluid which flows into the spiral fluid mixer flows from the fluid inlet 117 into the first spiral flow path forming the first spiral groove 122 of the main body part 119. The action by which the fluid flows through the flow path inside the main body part 119 to thereby make the distribution of concentration of the fluid in the direction of flow uniform without unevenness is similar to the first embodiment, so the explanation is omitted. Uniform fluid flows through the second spiral flow path which forms the second spiral groove 123 and out from the fluid outlet 118. At this time, the fluid mixer of the present embodiment is easy to disassemble and reassemble, and the ferrule coupling parts 114 and 115 enable easy attachment and detachment to and from the piping line, so this can be particularly preferably used in the food field where the work of disassembling the mixer, cleaning the parts, then reassembling them is frequently performed.

Figure 9:
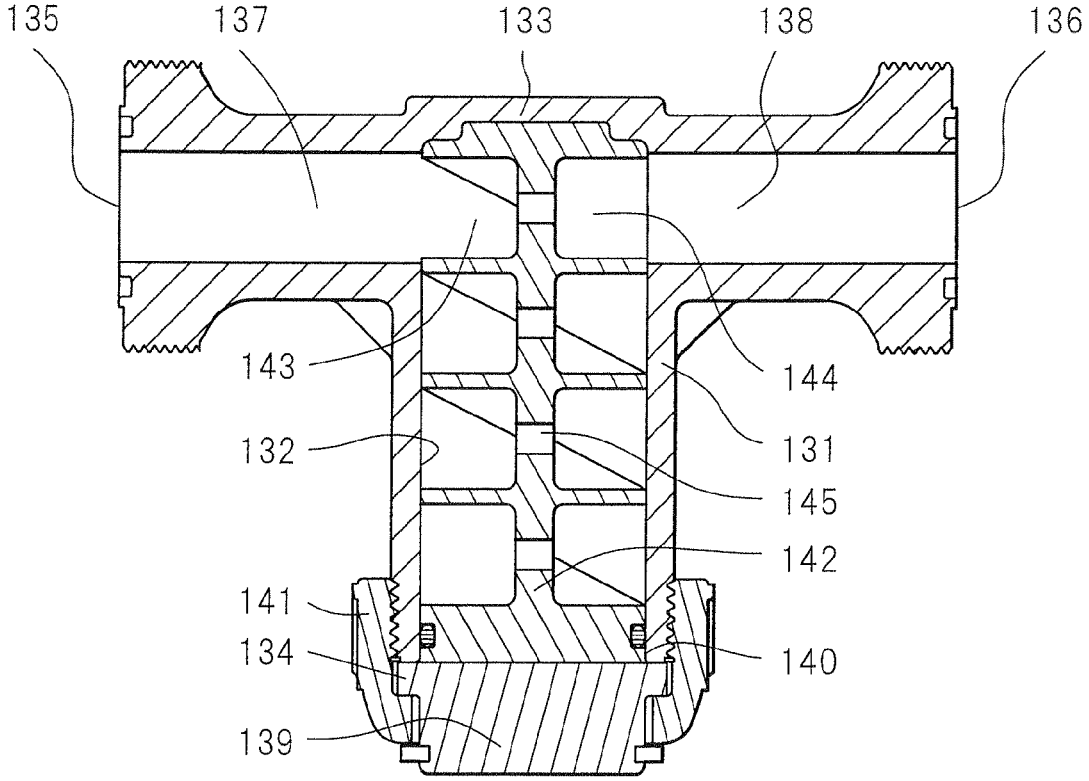
FIG. 9 is a longitudinal cross-sectional view of a pipe flow path showing a spiral type fluid mixer of a fifth embodiment of the present invention.
Figure 10:
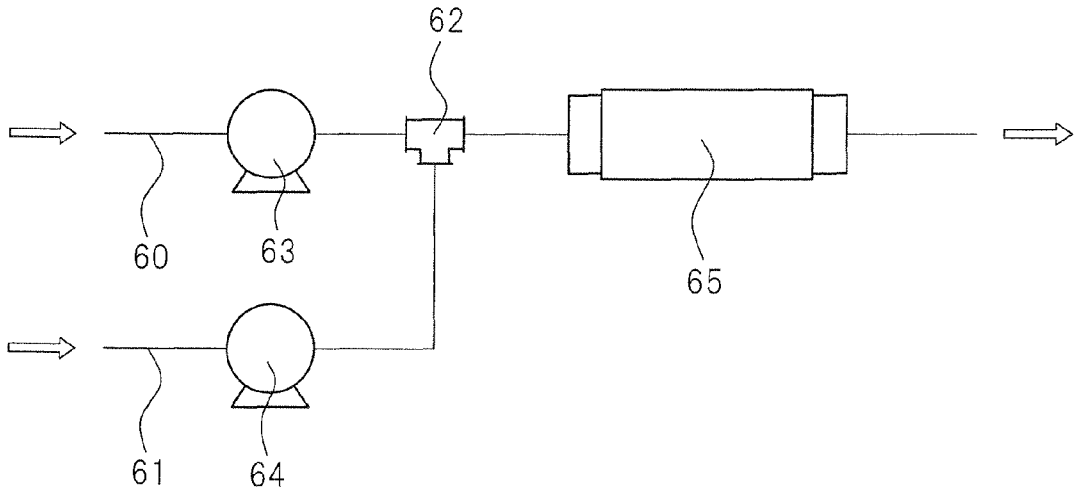
FIG. 10 is a schematic view showing an embodiment of an apparatus using a spiral type fluid mixer of the present invention of the present invention.
Figure 11:
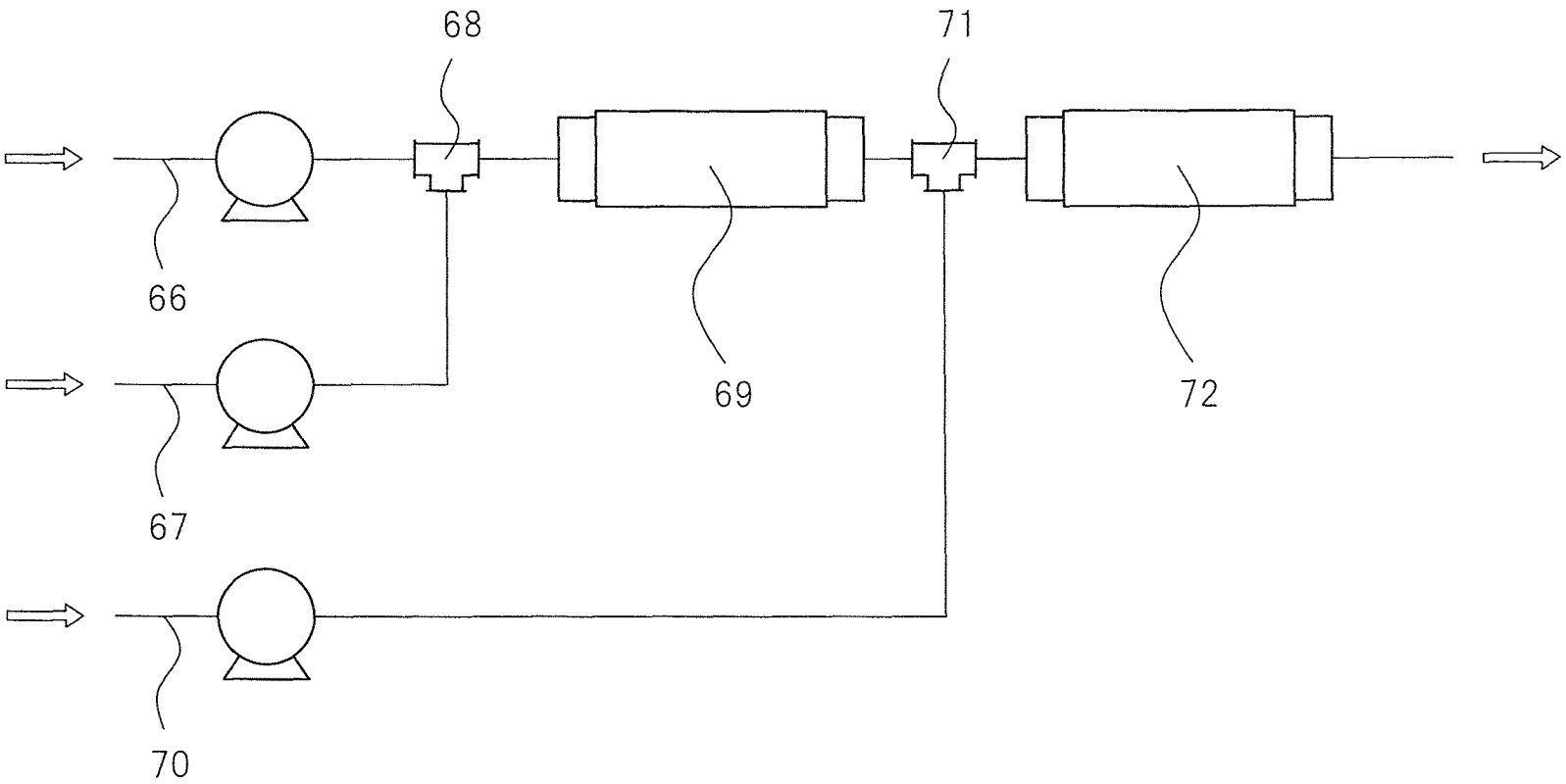
FIG. 11 is a schematic view showing another embodiment of an apparatus using a spiral type fluid mixer of the present invention of the present invention.
Figure 12:
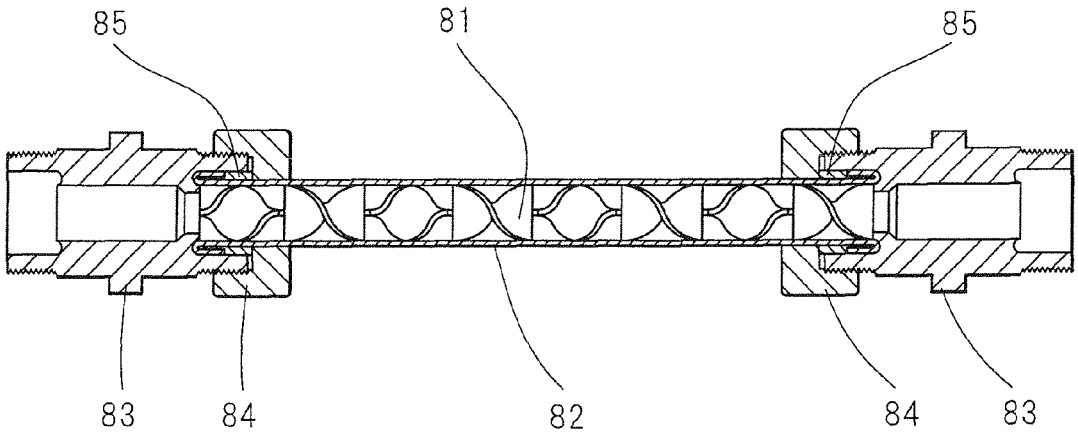
FIG. 12 is a longitudinal cross-sectional view showing a conventional static mixer.
Figure 13:
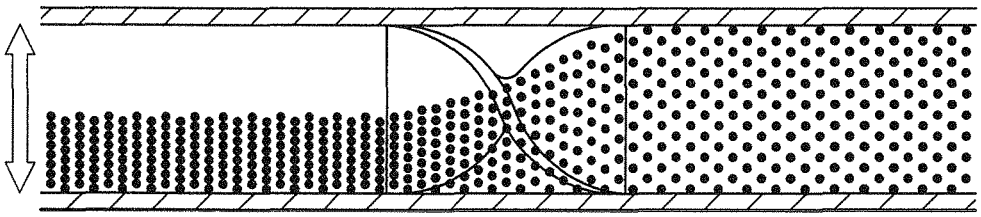
FIG. 13 is a schematic view of a state of agitation of fluid of the static mixer of FIG. 12.
Figure 13:
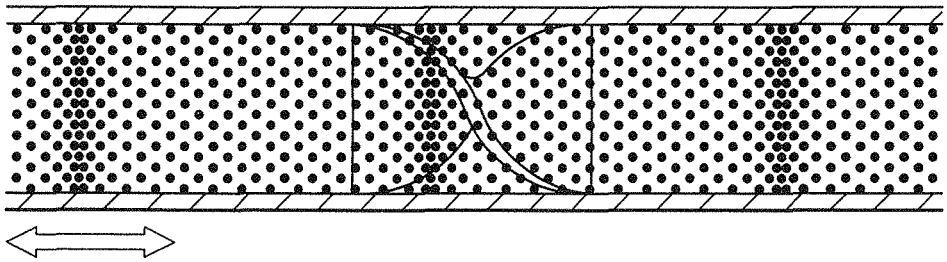

Next, referring to FIG. 9, a strainer shaped spiral type fluid mixer of a fifth embodiment of the present invention will be explained.

In the figure, 131 indicates a polyvinyl chloride (hereinafter referred to as "PVC") body. This is formed into a T-shaped pipe, is provided with a hollow chamber 132 at the bottom of the body 131, and has a seat 133 at the wall on the axial line of the hollow chamber 132 and an opening part 134 which opens to the bottom from the hollow chamber 132. At the two end faces of the body 131, a flange shaped fluid inlet 135 and fluid outlet 136 are formed. This therefore has a first flow path 137 which communicates the fluid inlet 135 and the hollow chamber 132 and a second flow path 138 which communicates the fluid outlet 136 and the hollow chamber 132.

A PVC lid member 139 is formed in a disk shape and is provided with a flange part 140 at the outer circumference of one end part.

A PVC cap nut 141 is formed into a cylindrical shape. At the inner circumference of one end part, a female thread part is provided to be screwed with a male thread part which is provided at the outer circumference of the opening part 134 of the body 131. At the other end part, an inner flange is provided with sticks out in the inner circumference direction. The cap nut 141 fastens the lid member 139 by abutting against the end face of the flange 140 of the lid member 139 at its inner flange and screwing over the male thread part of the body 131. This body 131 and lid member 139 form the housing. Note that, the lid member 139 and the later mentioned main body part 142 may also be provided as one piece. Further, it is also possible not to use the cap nut 141 but to form a female thread part on the lid member 139 and screw the member to the body 131 or to provide a female thread part on the opening part 134 of the body 131 and screw in a lid member 139 which has a male thread part. Further, the method of fastening is not particularly limited. Aside from screwing, if able to fasten the body 131 and lid member 139, a bayonet, ferrule, screws, etc. are possible.

The PVC main body part 142 is formed in a columnar shape. The outer circumferential surface of the main body part 142 is provided with a first spiral groove 143 and a second spiral groove 144 in parallel. The second spiral groove 144 is arranged between the grooves of the first spiral groove 143, while the first spiral groove 144 is arranged between the grooves of the second spiral groove 143. At the bottom surface of the first spiral groove 143, through holes 145 forming a plurality of branch flow paths communicating with the second spiral groove 144 are provided at equal intervals. The outer circumference of the main body part 142 is formed to substantially the same diameter as the inner circumference of the hollow chamber 132 of the body 131. At the outer circumference of one end part the main body part 142, a ring-shaped groove is provided which has an O-ring which forms a seal with the inside circumferential surface of the opening part 134. The main body part 142 is fit with the hollow chamber 132 from the opening part 134 of the body 131, the end part of the inserted main body part 142 is made to abut against the seat 133, the end part of the first spiral flow path which the first spiral groove 143 of the main body part 142 forms communicates with the first flow path 137 of the body 131, and the end part of the second spiral flow path which the first spiral groove 144 forms communicates with the second flow path 138 of the body 131.

Next, the action of the sixth embodiment will be explained.

The fluid which flows into the spiral type fluid mixer runs from the fluid inlet 135 of the body 131 through the first flow path 137 into the first spiral flow path formed by the first spiral groove 143 of the main body part 142. By flowing through the flow path in the main body part 142, the action whereby the distribution of concentration in the direction of flow of the fluid is made uniform without unevenness is similar to the second embodiment, so the explanation is omitted. The uniform fluid runs from the second spiral flow path formed by the second spiral groove 144 through the second flow path 138 out of the fluid outlet 136. At this time, the spiral type fluid mixer of the present embodiment is easy to disassemble and reassemble. It can be particularly used in the food field where the work of disassembling the mixer, cleaning the parts, and reassembling them is frequently performed.

Next, an apparatus using a spiral type fluid mixer of the present invention will be explained.

As the apparatus using a spiral type fluid mixer of the present invention, first, there is an apparatus in which a spiral type fluid mixer is installed in a line in which the temperature or concentration of the flowing substance changes along with time. This runs the fluid through the spiral type fluid mixer to enable the temperature or concentration of the fluid to be made uniform when for example a heater is set in the line, the temperature of the fluid heated by the heater fluctuates with respect to the time axis and thereby the temperature of the flowing fluid changes over time (not shown), when a solid substance stored in a tank is dissolved out into a fluid and the dissolved concentration changes over time in the line through which the fluid flows (not shown), etc. At this time, the substance which flows as a fluid is not limited so long as being a gas or liquid.

Figure 14:
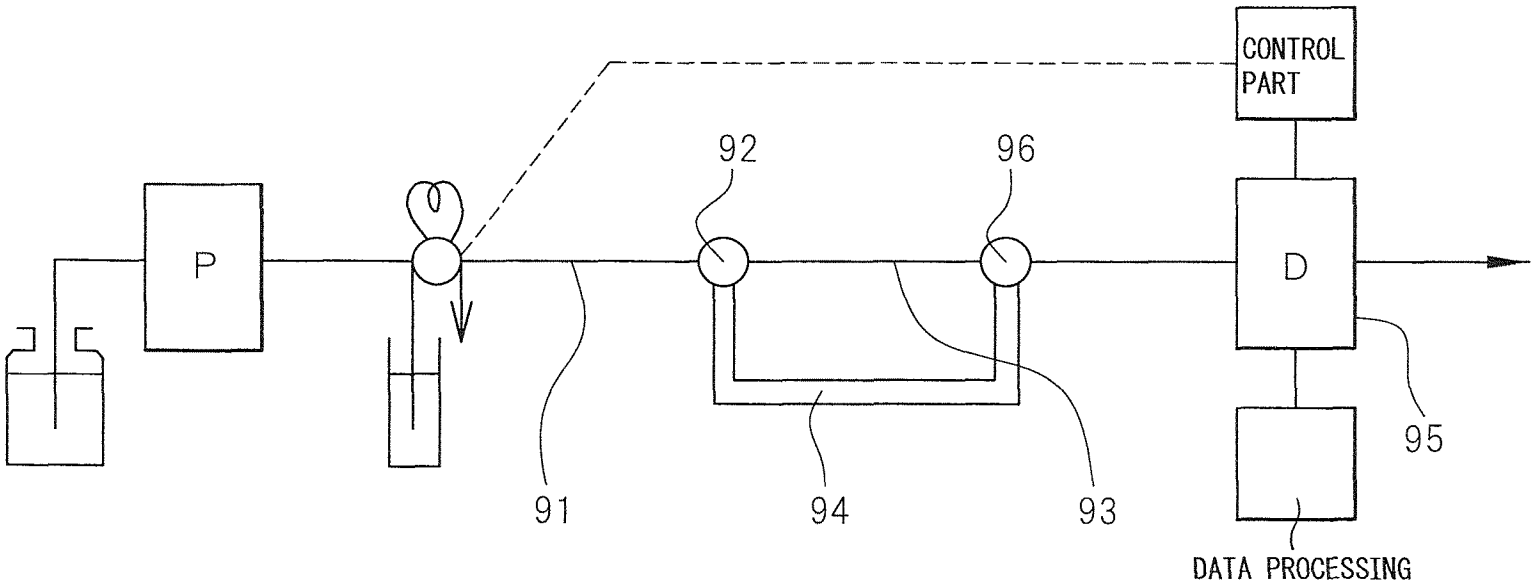
FIG. 14 is a longitudinal cross-sectional view showing a conventional branching and diluting apparatus.

Further, as shown in FIG. 14, there is an apparatus provided with the spiral type fluid mixer of the present invention at the downstream side of a merging part 62 of lines 60 and 61 through which two substances flow. This apparatus can use the fluid mixer 65 to make the mixing ratio of the substances uniform and thereby achieve a uniform temperature or concentration with respect to the time axis when the mixing ratio changes along with time when for example pumps 63 and 64 feeding two substances pulsate, when, in a line where a high temperature fluid and a low temperature fluid merge, the high temperature fluid flows unevenly, fluctuation occurs in the temperature of the fluid with respect to the time axis, and thereby the temperature of the flowing fluid changes over time, when, in a line where a known concentration of fluid is mixed with pristine fluid, the concentration of the mixed fluid changes over time, etc. The substance run as a fluid at this time may be any of a gas, liquid, solid, or powder. The solid or powder has to be able to be run through a line. It may be mixed with a gas or liquid in advance. Note that, it is also possible to make the apparatus one in which lines through which three or more substances flow are merged and in which three or more substances are thereby mixed by the fluid mixer.

Further, as shown in FIG. 15, it is also possible to arrange the spiral type fluid mixer 69 of the present invention at the downstream side of the merging part 68 of the lines 66 and 67 through which the two substances flow and to arrange another spiral type fluid mixer 72 at the downstream side of the merging part 71 where a line 70 through which another substance flows merges at the downstream side of the spiral type fluid mixer 69. When simultaneously mixing three or more substances and uneven mixing would result etc., this makes it possible to make the two first mixed substances to be made uniform, then the other substances to be mixed to be made uniform and thereby enable efficient uniform mixing with no unevenness. For example, when mixing water, oil, and a surfactant, if mixing everything all at once, they will not be mixed well and uneven mixing will occur, so it is possible to mix the water and surfactant in advance, then mix the result with the oil so as to enable uniform mixture with no unevenness; to mix the water and sulfuric acid for dilution, then mix the mixture with ammonia gas for absorption of the ammonia gas; to mix the water and sulfuric acid for dilution, then mix the mixture with sodium silicate and adjust the pH, etc. for the most suitable mixing operation. Note that, it is also possible to first run and combine three or more substances or combine two or more substances in the middle. Further, similarly, it is also possible to connect three or more spiral type fluid mixers and mix other substances in stages.

Next, embodiments of various combinations of substances which are mixed by the present apparatus will be explained.

In the apparatus of FIG. 14, it is possible to run water through the line 60 through which one substance flows and to run a pH adjuster, liquid fertilizer, bleach, bactericide, surfactant, or liquid chemical through the line 61 through which the other substance flows so as to be mixed and made uniform by an apparatus using the fluid mixer 65.

The water at this time may be pure water, distilled water, tap water, industrial water, etc. It is not particularly so long as meeting the conditions of the substance to be mixed with. Further, the temperature of the water is also not particularly limited. Warm water or cold water may be used.

The pH adjuster need only be an acid or alkali used for adjusting the pH of the liquids to be mixed. Hydrochloric acid, sulfuric acid, nitric acid, fluoric acid, carbonic acid, citric acid, gluconic acid, succinic acid, potassium carbonate, sodium hydrogen carbonate, sodium hydroxide aqueous solution, etc. may be mentioned.

The liquid fertilizer may be any liquid fertilizer for agricultural use. Manure or a chemical fertilizer etc. may be mentioned.

The bleach may be any one which utilizes the oxidation and reduction reaction of a chemical substance to break down color. Sodium hypochlorite, sodium percarbonate, hydrogen peroxide, ozone water, thiourea dioxide, sodium dithionite, etc. may be mentioned.

A bactericide is a chemical for killing microorganisms having pathogenicity or toxicity. An iodine tincture, povidone iodine, sodium hypochlorite, chloride of lime, mercurochrome, chlorhexidine gluconate, acrinol, ethanol, isopropanol, hydrogen peroxide aqueous solution, benzalkonium chloride, cetylpyridinium chloride, saponated cresol solution, sodium chlorite, hydrogen peroxide, sodium hypochlorite, hypochlorous acid water, ozone water, etc. may be mentioned.

The surfactant is a substance having parts in the molecule with affinity with water (hydrophilic groups) and parts with affinity with oil (lyophilic groups and hydrophobic groups). A fatty acid sodium salt, fatty acid potassium salt, monoalkyl sulfuric acid salt, alkyl polyoxyethylene sulfuric acid salt, alkylbenzene sulfonic acid salt, monoalkyl phosphoric acid salt, alkyltrimethyl ammonium salt, dialkyldimethyl ammonium salt, alkylbenzyl dimethyl ammonium salt, alkyldimethylamine oxide, alkylcarboxybetaine, polyoxyethylene alkyl ether, fatty acid sorbitan ester alkylpolyglucoside fatty acid diethanolamide, alkylmonoglyceryl ether, α-sulfofatty acid ester sodium salt, linear alkylbenzenesulfonic acid sodium salt, alkylsulfonic acid ester sodium salt, alkylether sulfonic acid ester sodium salt, α-olefin sulfonic acid sodium salt, alkyl sulfonic acid sodium salt, sucrose fatty acid ester sorbitan fatty acid ester, polyoxyethylene sorbitan fatty acid ester, fatty acid alkanolamide, polyoxyethylene alkyl ether, polyoxyethylene alkyl phenyl ether, alkyl amino fatty acid sodium salt, alkylbetaine, alkylaminoxide, alkyltrimethyl ammonium salt, dialkyldimethyl ammonium salt, etc. may be mentioned.

Further, so long as within the range of liquid chemicals, a liquid chemical which does not fall under the above categories may also be used. Hydrochloric acid, sulfuric acid, acetic acid, nitric acid, formic acid, fluoric acid, sodium hydroxide, potassium hydroxide, calcium hydroxide, barium hydroxide, ammonium hydroxide, sodium silicate, oil, etc. may be mentioned. Note that, the liquid chemicals mentioned here are also used chemicals corresponding to the above categories. Further, it is also possible to run cold water through the line 60 through which one substance flows and run hot water through the line 61 through which the other substance flows and to mix the cold water and hot water to give a uniform, constant temperature.

Further, it is also possible to run a first liquid chemical through the line 60 through which one substance flows and run a second liquid chemical or metal through the line 61 through which the other substance flows so as to be mixed by an apparatus using the fluid mixer 65. The first and second liquid chemicals to be mixed here may be any liquid chemicals which can be mixed. The above liquid chemicals or other liquid chemicals may also be used. For example, photoresist and thinner etc. may be mentioned. Further, the liquid chemical may also be a cosmetic. As the cosmetic, a facial cleanser, cleansing solution, toilet water, beauty essence, milky lotion, cream, gel, or other such foundation cosmetic aimed at preparing the skin itself or medicinal use and other products, corresponding to "quasi drugs" in Japan, aimed at preventing bad breath, body odor, heat rashes, sores, hair loss, etc., at promoting hair growth or removing hair, driving away mice or insects, etc. may be mentioned.

The metal is mainly an organometallic compound and is used as fine granules, a powder, or as a liquid obtained by dissolution in an organic solvent etc. As the organometallic compound, organozinc compounds such as chloro(ethoxycarbonylmethyl)zinc, organocopper compounds such a lithium dimethyl cuprate, Grignard reagents, organomagnesium compounds such as iodo(methyl)magnesium and diethyl magnesium, organolithium compounds such as n-butyl lithium, metal carbonyl, carbene complexes, ferrocene and other metallocenes and other organometallic compounds, single element or multiple element mixed standard solutions dissolved in paraffin oil, etc. may be mentioned. Further, silicon, arsenic, boron, and other semimetal compounds or aluminum or other such base metals are included. The organic metal compound is suitably used as a catalyst in the production of a petrochemical product or the production of an organic polymer.

Further, it is also possible to run a waste liquid through the line 60 through which one substance flows and run a pH adjuster or flocculant through the line 61 through which the other substance flows so as to be mixed by an apparatus using the fluid mixer 65. The pH adjuster used may be the above pH adjuster. The flocculant is not particularly limited so long as causing flocculation of the waste liquor. Ammonium sulfate, polyferrous sulfate, polyaluminum chloride, polysilica iron, calcium sulfate, ferrous chloride, slaked lime, etc. may be mentioned. The microorganism need only be one which promotes fermentation or breakdown of waste liquor. A mold, yeast, or other fungi, bacteria or other microorganisms etc. may be mentioned.

Further, it is possible to run a first petroleum oil through the line 60 through which one substance flows and run a second petroleum oil, additive, or water through the line 61 through which the other substance flows so as to be mixed by an apparatus using the fluid mixer 65. Here, the "first and second petroleum oils" mean liquid oils having hydrocarbons as main ingredients and also containing small amounts of sulfur, oxygen, nitrogen, and various other substances. Naphtha (gasoline), kerosene, diesel oil, heavy oil, lubricating oil, asphalt, etc. may be mentioned. The "additive" referred to here indicates something which is added to improve or maintain the quality of petroleum oil. As a lubrication oil additive, a detergent dispersant, antioxidant, viscosity index improver/pour point depressant, oiliness agent/extreme pressure additive, antiwear agent, antirust/anticorrosive agent, etc. may be mentioned, while as a grease additive, a structural stabilizer, filler, or other fuel oil additive etc. may be mentioned. The water referred to here may be pure water, distilled water, tap water, industrial water, etc. It is not particularly limited so long as water meeting the conditions of the substances to be mixed. Further, the temperature of the water is not particularly limited. Hot water or cold water may be used.

Further, it is also possible to run a first resin through the line 60 through which one substance flows and run a second resin, solvent, curing agent, and coloring agent through the line 61 through which the other substance flows so as to be mixed by an apparatus using the fluid mixer 65. The "resin" referred to here is a molten resin, liquid resin, or other main ingredient of an adhesive or coat forming ingredient of a coating. The molten resin is not particularly limited so long as a resin which can be injection molded or extruded. Polyethylene, polypropylene, polyvinyl chloride, polystyrene, tetrafluoroethylene-perfluoroalkyl vinyl ether copolymer, ABS resin, acryl resin, polyamide, nylon, polyacetal, polycarbonate, modified polyphenylene ether, polybutylene terephthalate, polyethylene terephthalate, polyphenylene sulfide, polyether ether ketone, etc. may be mentioned.

As the liquid resin or other main ingredient of an adhesive, an acrylic resin-based adhesive, α-olefin-based adhesive, urethane resin-based adhesive, ether-based cellulose, ethylene-vinyl acetate resin adhesive, epoxy resin-based adhesive, vinyl chloride resin solvent-based adhesive, chloroprene rubber-based adhesive, vinyl acetate resin-based adhesive, cyanoacrylate-based adhesive, silicone-based adhesive, water-based polymer-isocyanate-based adhesive, styrene-butadiene rubber solution-based adhesive, styrene-butadiene rubber-based latex adhesive, nitrile rubber-based adhesive, nitrocellulose adhesive, reactive hot melt adhesive, phenol resin-based adhesive, modified silicone-based adhesive, polyamide resin hot melt adhesive, polyimide-based adhesive, polyurethane resin hot melt adhesive, polyolefin resin hot melt adhesive, polyvinyl acetate resin solution-based adhesive, polystyrene resin solvent-based adhesive, polyvinyl alcohol-based adhesive, polyvinyl pyrrolidone resin-based adhesive, polyvinyl butyral resin-based adhesive, polybenzimidazole adhesive, polymethacrylate resin solution-based adhesive, melamine resin-based adhesive, urea resin-based adhesive, resorcinol-based adhesive, etc. may be mentioned. As the coating forming ingredient of the coating, an acryl resin, urethane resin, melamine resin, etc. may be mentioned.

As the solvent, hexane, benzene, toluene, diethyl ether, chloroform, ethyl acetate, tetrahydrofuran, methylene chloride, acetone, acetonitrile, dimethylsulfoxide, dimethylformamide, dimethylacetoamide, N-methylpyrrolidone, ethanol, methanol, etc. may be mentioned. As the curing agent, polyamine, acid anhydrides, amines, peroxides, saccharin, etc. may be mentioned. As the coloring agents, zinc white, lead white, lithopone, titanium dioxide, precipitated barium sulfate, barite powder, red lead, iron oxide red, yellow lead, zinc yellow, ultramarine blue, potassium ferrocyanide, carbon black, and other pigments may be mentioned.

Here, when the above resin is a molten resin, it is also possible to form an apparatus running molten resin from a molding machine or extruder to the fluid mixer 65 (not shown). For example, in the case of a molding machine, it is possible to arrange the fluid mixer 65 between the nozzle of the molding machine and mold for injection molding or, in the case of an extruder, arrange the fluid mixer 65 between the extruder and die for extrusion. In this case, it is possible to make the temperature in the resin uniform, stabilize the viscosity of the resin, suppress unevenness of thickness or generation of internal stress, and eliminate unevenness of color.

Further, it is also possible to run a first food material through the line 60 through which one substance flows and to run a second food material, food additive, seasoning, or nonflammable gas through the line 61 through which the other substance flows so as to be mixed by an apparatus using the fluid mixer 65.

The first and second food materials need only be beverages or foods which can flow through pipelines. Sake rice wine, shochu distilled spirits, beer, whisky, wine, vodka, and other alcoholic beverages, milk, yoghurt, butter, cream, cheese, condensed milk, milk fat, and other milk products, juice, tea, coffee, soymilk, water, and other beverages, soup stock, miso soup, consommé soup, corn soup, tonkotsu pig bone soup, and other liquid foods, and also jelly, konjak powder paste, pudding, chocolate, ice cream, candies, tofu, paste products, beaten egg, gelatin, and other various food materials etc. may be mentioned. Further, if fluid in nature, a solid or powder is also possible. Flour, potato starch, strong wheat flour, weak wheat flour, buckwheat flour, powdered milk, coffee, cocoa, and other powder materials or meat, wakame seaweed, sesame seeds, green laver, kezuribushi dried fish shavings, bread crumbs, minced or grated food or other small solid foods etc. may be mentioned.

As the food additive, brown sugar, evaporated cane juice, fructose, maltose, honey, molasses, maple syrup, starch syrup, erythritol, trehalose, maltitol, palatinose, xylitol, sorbitol, somatin, saccharin sodium, cyclamic acid, dulcin, aspartame, acesulfame potassium, sucralose, neotame, or other sweeteners, caramel color, gardenia coloring, anthocyanin coloring, annatto coloring, paprika coloring, safflower coloring, monascus coloring, flavonoid coloring, cochineal coloring, Amaranth, Erythrosine, Allura Red AC, New Coccine, Phloxine, Rose Bengal, Acid Red, Tartrazine, Sunset Yellow FCF, Fast Green FCF, Brilliant Blue FCF, Indigo Carmine, and other coloring agents, sodium benzoate, ϵ-polylysine, soft roe protein extract (protamine), potassium sorbate, sodium, sodium dehydroacetate, Thujaplicin (hinokitol), or other preservatives, ascorbic acid, tocopherol, dibutyl hydroxytoluene, butyl hydroxyanisole, sodium erythorbate, sodium sulfite, sulfur dioxide, chlorogenic acid, catechinic acid, or other antioxidants, flavors and fragrances, etc. may be mentioned.

As the seasoning, soysauce, sauce, vinegar, oil, chile sauce, miso soybean paste, ketchup, mayonnaise, salad dressing, sweet sake, and other liquid seasonings or sugar, salt, pepper, Japanese pepper, powdered red pepper, and other powder seasonings etc. may be mentioned. Microorganisms promote the fermentation and breakdown of food and include mushrooms, mold, yeast, or other fungi and bacteria and other microorganisms. As the fungi, various types of mushrooms, *aspergillus*, etc. may be mentioned. As the bacteria, for example, *lactobacillus bifidus, lactobacillus, bacillus subtilis natto*, etc. may be mentioned. As the nonflammable gas, carbon dioxide gas etc. may be mentioned. For example, the mixer can be used for mixing sweet wort and carbon dioxide gas to produce beer.

Further, it is also possible to run air through the line 60 through which one substance flows and run a flammable gas through the line 61 through which the other substance flows so as to be mixed by an apparatus using the spiral type fluid mixer 65. As the flammable gas, methane, ethane, propane, butane, pentane, acetylene, hydrogen, carbon monoxide, ammonia, dimethyl ether, etc. may be mentioned.

Further, it is also possible run a first nonflammable gas through the line 60 through which one substance flows and run a second nonflammable gas or steam through the line 61 through which the other substance flows so as to be mixed by an apparatus using the fluid mixer 65. As the nonflammable gas, nitrogen, oxygen, carbon dioxide, argon gas, helium gas, hydrogen sulfide gas, sulfurous acid gas, sulfur oxide gas, etc. may be mentioned. Further, as another combination of the above, it is also possible to run water, a liquid chemical, or a food material through the line 60 through which one substance flows and run air, a nonflammable gas, or steam through the line 60 through which the other substance flows so as to be mixed by an apparatus using the fluid mixer 65.

Further, it is also possible to run a first synthesis intermediate through the line 60 through which one substance flows and run the second synthesis intermediate, additives, liquid chemicals, or metal through the line 61 through which the other substance flows so as to be mixed by an apparatus using the fluid mixer 65. The first and second synthesis intermediates mean compounds at the stage in the middle of synthesis appearing in the middle of the multistage synthesis process until the target compound. Compounds in the middle of synthesis obtained by mixing a plurality of chemicals, resins in the middle of refinement, pharmaceutical intermediates, etc. may be mentioned.

Note that the combinations of substances to be mixed by the above apparatus using a spiral type fluid mixer of FIG. 14 may also be combined using the apparatus of FIG. 15 etc. Further, in the apparatuses using fluid mixers of FIG. 14 and FIG. 15, it is also possible to provide a heater or vaporizer at each of the lines through which substances flow before merging (not shown) and possible to provide heat exchangers at the downstream side of the fluid mixers (not shown). Further, it is also possible to set a measuring device at a line through which one substance flows before merging and provide a control unit for adjusting the output of the pump of the line through which the other substance flows in accordance with a parameter measured by that measuring device (not shown) or to set a control valve at the line through which the other substance flows and provide another control valve for adjusting the opening degree of that control valve in accordance with a parameter of that measuring device (not shown). At this time, the measuring device may be any which can measure a parameter of the fluid required such as a flowmeter, current meter, densitometer, or pH meter. Further, it is also possible to install a static mixer in the flow path at the downstream side of the merging part of the lines. The fluid mixer may be used to make flow uniform in the axial direction of the flow path, while the static mixer may be used to make the flow uniform in the diametrical direction of the flow path, so the fluid can be mixed more uniformly.

Note that, the present invention was explained in detail based on specific embodiments, but a person skilled in the art could make various modifications, corrections, etc. without departing from the claims and idea of the present invention.

REFERENCE SIGNS LIST

1 fluid inlet
2 first flow path
3 fluid outlet
4 second flow path
5 first spiral flow path
6 second spiral flow path
7*a* to 7*e* branch flow path
11 main body part
12 first spiral groove
13 second spiral groove
14 through hole
15 cylindrical member
16 first spiral flow path
17 second spiral flow path
18 fluid inlet
19 fluid outlet
20 first flow path
21 second flow path
22 first spiral flow path
23 second spiral flow path
24 first flow path
25 second flow path
26 through hole
27 main body part
28 cylindrical member
31 swirl blade
32 base member
33 through hole
34 cylindrical member
35 fluid inlet
36 fluid outlet
37 first flow path
38 second flow path
39 first spiral flow path
40 second spiral flow path

The invention claimed is:

1. A spiral type fluid mixer provided with a fluid inlet, a first flow path which is connected to said fluid inlet, a first spiral flow path which is connected to said first flow path, a plurality of branch flow paths which are branched from said first spiral flow path, a second spiral flow path to which said plurality of branch flow paths are connected, a second flow path which is connected to said second spiral flow path, and a fluid outlet which is connected to said second flow path, said plurality of branch flow paths being branched from different positions of said first spiral flow path and being connected with said second spiral flow path at different positions of said second spiral flow path, wherein the spiral type fluid mixer is provided with a main body part which is formed with a first spiral groove and a second spiral groove at its outer circumference and is formed with a plurality of through holes so as to communicate said first spiral groove and said second spiral groove, said second spiral groove being arranged between grooves of said first spiral groove, said first spiral groove being arranged between grooves of said second spiral groove, and a housing which fits with an outer circumferential surface of said main body part, said main body part or said housing being formed with said first flow path which is connected to one end part of said first spiral groove and said second flow path which is connected to one end part of said second spiral groove, said fluid inlet which is connected to said first flow path and said fluid outlet which is connected to said second flow path being arranged at an end face of said main body part or an outer circumference of said housing, said first spiral groove and an inner circumferential surface of said housing forming said first spiral flow path, said second spiral groove and the inner circumferential surface of said housing forming said second spiral flow path, and said through holes forming inlets for said branch flow paths.

2. A spiral type fluid mixer as set forth in claim 1, characterized in that said first spiral flow path is formed to become gradually smaller in flow section area from one end part which is connected to said first flow path to another end part.

3. A spiral type fluid mixer as set forth in claim 1, characterized in that it is provided with a swirl blade which has the shape of a rectangular member twisted about its longitudinal axial line by at least 180° and a housing which fits with side surfaces of said swirl blade, said swirl blade and said housing inside circumferential surface forming said first spiral flow path and said second spiral flow path, said swirl blade being formed with a plurality of through holes so as to communicate said first spiral flow path and said second spiral flow path, and being formed with said first flow path which is connected to one end part of a first spiral groove and said second flow path which is connected to one end part of a second spiral groove, an outer circumference of said housing having arranged at it said fluid inlet which is connected to said first flow path and said fluid outlet which is connected to said second flow path, and said through holes becoming said branch flow paths.

4. A spiral type fluid mixer as set forth in claim 1, characterized in that said through holes are formed with substantially the same opening areas.

5. A spiral type fluid mixer as set forth in claim 1, characterized in that the housing is provided with a ferrule coupling part.

6. A spiral type fluid mixer as set forth in claim 1, characterized in that the housing is formed by two or more members, each member is provided with a flange part, and the flange parts are fastened by clamps.

7. A spiral type fluid mixer as set forth in claim 6, characterized in that the housing is comprised of two cylindrical parts, an outer circumference of one end part of each cylindrical part is provided with a flange part, while the other end part is provided with a reduced diameter part which is reduced in diameter, and the main body part is inserted into opening parts of the two cylindrical parts at the flange part sides, and the flange parts are fastened by clamps.

8. A spiral type fluid mixer as set forth in claim 1, wherein the housing is comprised of a body provided with a hollow chamber opening at the bottom, the hollow chamber having an inlet flow path and outlet flow path communicated with it, and a lid member closing an opening of the hollow chamber, and the main body part is arranged fit into the hollow chamber of the housing.

* * * * *